US005975338A

United States Patent [19]

Przytulla et al.

[11] Patent Number: 5,975,338

[45] Date of Patent: Nov. 2, 1999

[54] DRUM WITH IMPROVED EMPTYING FEATURE

[75] Inventors: Dietmar Przytulla, Kerpen; Märten Burgdorf, Heimerzheim, both of Germany

[73] Assignee: Mauser-Werke GmbH, Germany, Germany

[21] Appl. No.: 07/923,877

[22] PCT Filed: Dec. 21, 1990

[86] PCT No.: PCT/EP90/02283

§ 371 Date: Aug. 11, 1992

§ 102(e) Date: Aug. 11, 1992

[87] PCT Pub. No.: WO91/12179

PCT Pub. Date: Aug. 22, 1991

[30] Foreign Application Priority Data

Feb. 15, 1990 [DE] Germany ..... 90 01 802 U
May 23, 1990 [DE] Germany ..... 40 16 600

[51] Int. Cl.[6] ..... B65D 6/40

[52] U.S. Cl. ..... 220/601

[58] Field of Search ..... 220/601, 661, 220/465, DIG. 1, DIG. 6

[56] References Cited

U.S. PATENT DOCUMENTS

| | | | |
|---|---|---|---|
| Re. 28,874 | 6/1976 | Hammes | 220/601 |
| 2,181,905 | 12/1939 | McCrery | 220/DIG. 1 |
| 2,381,386 | 8/1945 | Kuhn | 220/DIG. 1 |
| 3,647,110 | 3/1972 | Hammes . | |
| 3,934,747 | 1/1976 | Needt . | |
| 3,955,705 | 5/1976 | Dubois et al. | 206/509 |
| 4,094,432 | 6/1978 | Zilbert . | |
| 4,378,328 | 3/1983 | Przytulla et al. . | |
| 4,674,648 | 6/1987 | Przytulla et al. . | |
| 4,736,862 | 4/1988 | Hammes et al. . | |
| 4,767,021 | 8/1988 | Pies . | |
| 4,776,479 | 10/1988 | Schutz . | |
| 4,898,296 | 2/1990 | Burgdorf et al. . | |
| 4,925,049 | 5/1990 | Przytulla . | |
| 4,934,551 | 6/1990 | Büdenbender . | |
| 5,014,873 | 5/1991 | Clemens . | |
| 5,033,639 | 7/1991 | Przytulla | 220/661 |
| 5,044,510 | 9/1991 | Schütz . | |

FOREIGN PATENT DOCUMENTS

| | | | |
|---|---|---|---|
| 0 287 966 | 10/1988 | European Pat. Off. . | |
| 0 291 695 | 11/1988 | European Pat. Off. . | |
| 0 366 129 | 5/1990 | European Pat. Off. . | |
| 29 14 938 | 10/1980 | Germany . | |
| 86 30 590 | 2/1987 | Germany . | |
| 86 31 318 | 2/1987 | Germany . | |
| 87 00 445 | 4/1987 | Germany . | |
| 87 13 783 | 1/1988 | Germany . | |
| 36 36 758 | 5/1988 | Germany . | |
| 38 23 119 | 1/1990 | Germany . | |
| 90 01 802 | 5/1990 | Germany . | |
| 4108655 | 9/1992 | Germany | 220/601 |
| 518598 | 3/1940 | United Kingdom | 220/601 |
| 2 079 237 | 1/1982 | United Kingdom . | |
| 2220379 | 1/1990 | United Kingdom . | |

*Primary Examiner*—Stephen Castellano
*Attorney, Agent, or Firm*—Pennie & Edmonds LLP

[57] ABSTRACT

The invention relates to a bung drum of thermoplastic synthetic material, having a circumferential carrying and transport ring disposed on the drum wall in the vicinity of the upper end and having at least one bung hole located in the edge region of the upper end. The upper end of the drum has a slope surface on both sides of the bung hole. When seen in the normal position of the barrel, the slope surface slopes downwardly in the direction of the edge of the drum with its lowest point in the vicinity of the bung hole.

23 Claims, 5 Drawing Sheets

Figure 4:
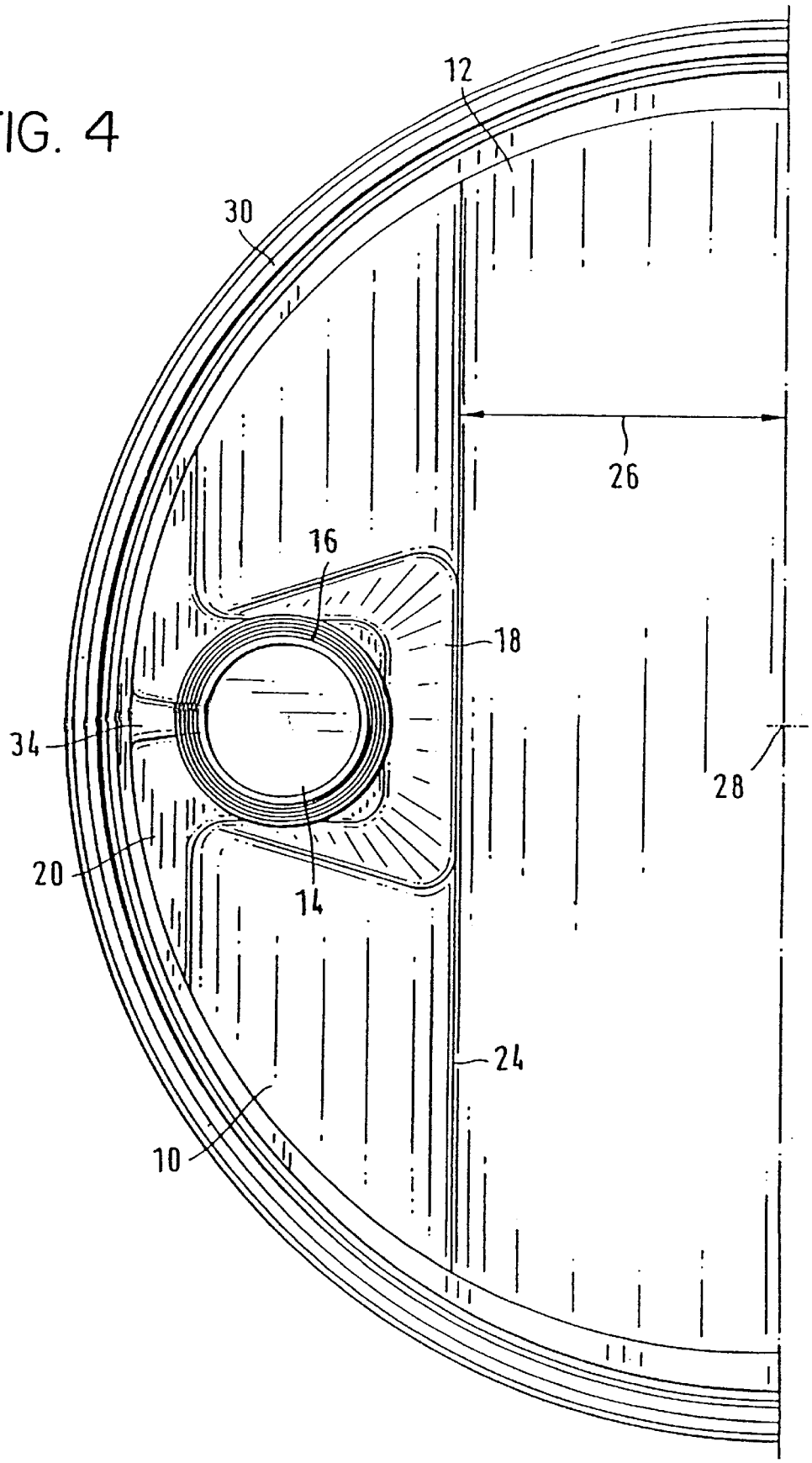

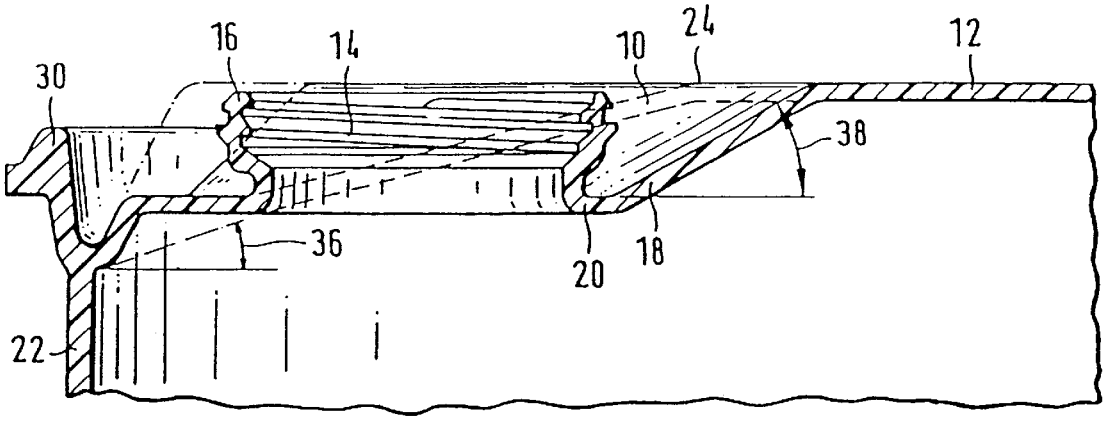
FIG. 1
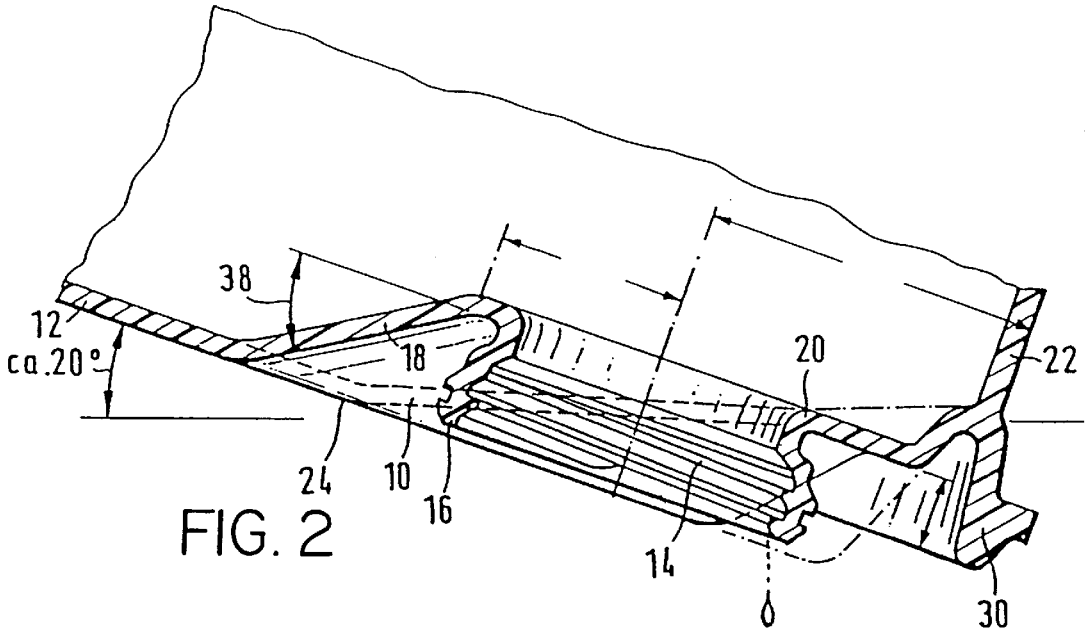
FIG. 2
FIG. 3
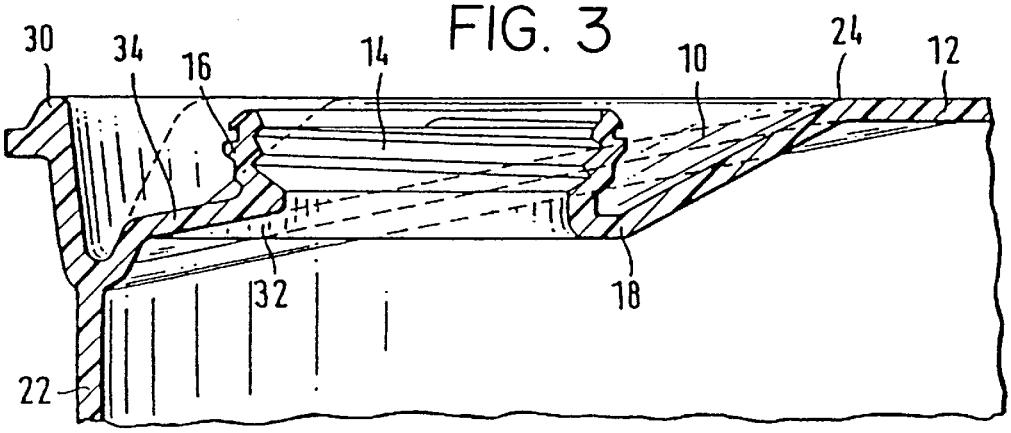

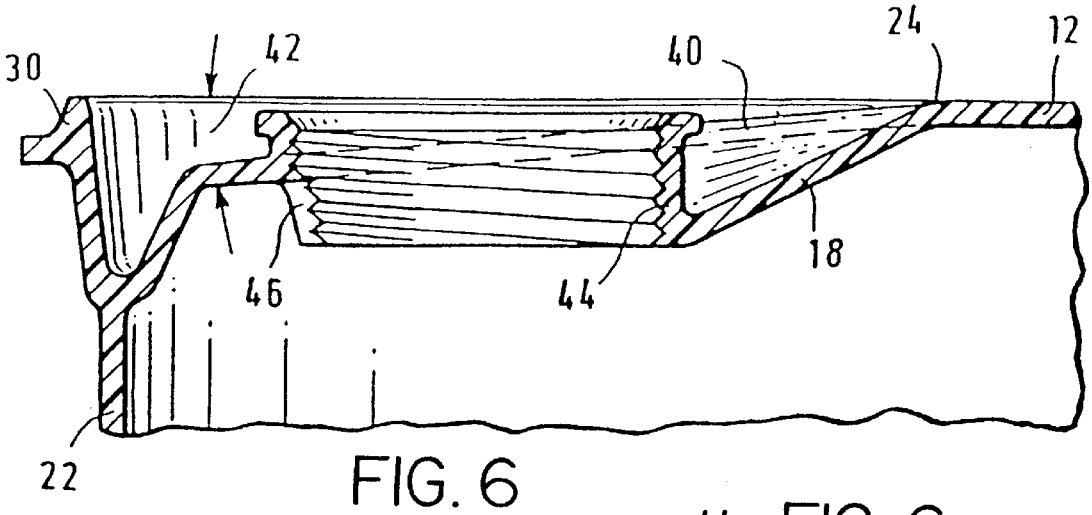
FIG. 6
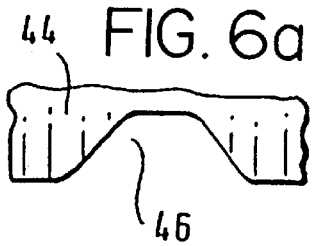
FIG. 6a
FIG. 7
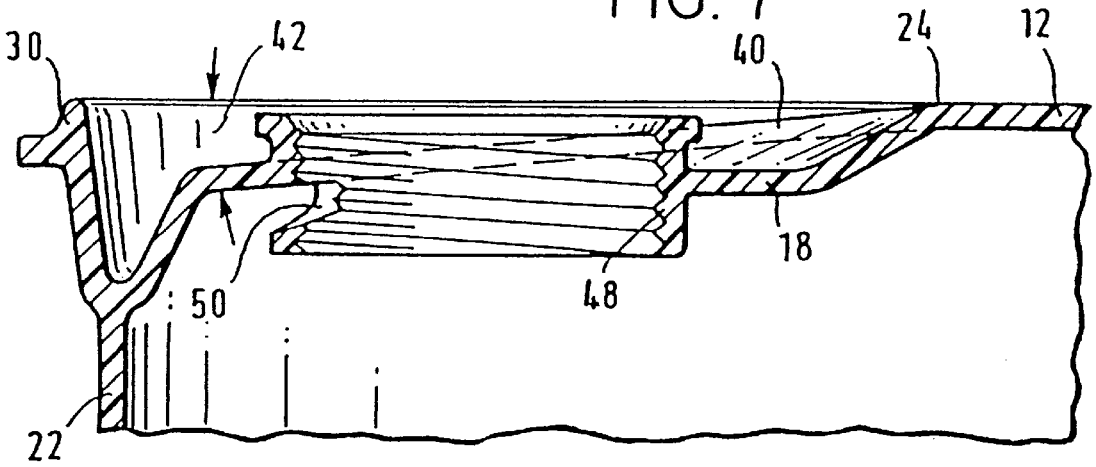
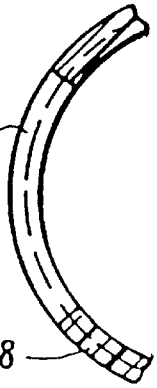
FIG. 7a
FIG. 7b
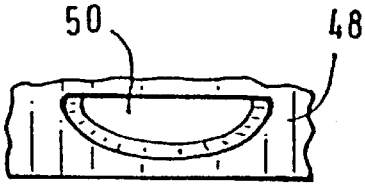

FIG. 8
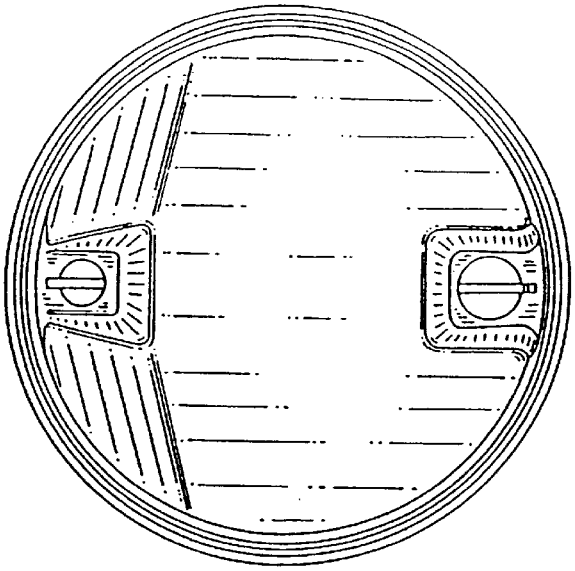
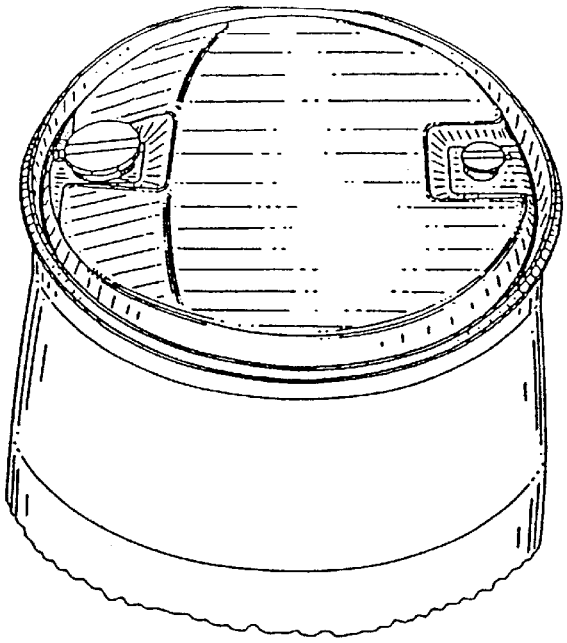
FIG. 9
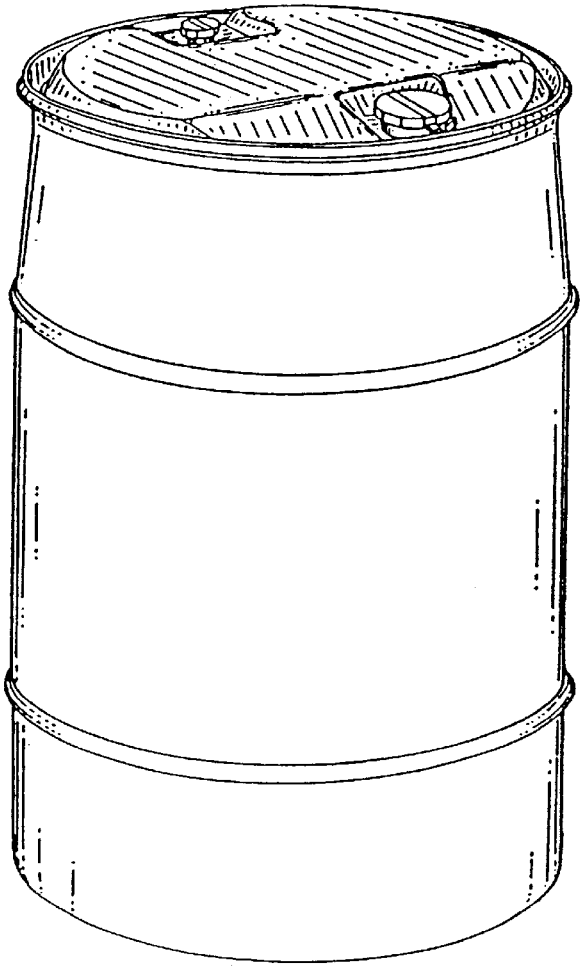
FIG. 10

DRUM WITH IMPROVED EMPTYING FEATURE

The invention relates to a bung barrel of thermoplastic synthetic material, having a circumferential carrying and transporting ring disposed on the barrel wall in the vicinity of the upper end and having at least one bung hole socket located in the edge region of the upper end, which bung hole socket is sunk into a bung hole housing so that the end face of the bung hole socket terminates flush with or slightly below the outer surface of the upper end.

Plastics drums of this kind having at least one gripping ring for a barrel grip located at the upper circumferential region of the drum wall and optionally additional rolling rings on the periphery of the drum, are generally known. Plastics bung barrels may be manufactured by various methods. According to one manufacturing option, the drum is made in one piece with drum ends and carrying and transporting rings using the blow-moulding process, the carrying and transporting rings being upset by means of movable mould slides while still in the blow mould (for example DE-PS 29 14 938). According to another method variant, the cylindrical body of the drum and the drum ends with carrying and transporting rings and/or rolling rings are preproduced separately as individual components and are then welded or glued together (for example U.S. Pat. No. 3,394,747). It is also already known to preproduce only the carrying and transporting rings as separate individual components and to then weld them or glue them to the blow-moulded body of the drum.

In a further known plastics bung barrel, the upper end with carrying and transporting ring is screwed onto the wall of the drum as a detachable individual component (for example U.S. Pat. No. 4,094,432). The plastics drum may however also be formed as a wide-necked container with detachable bung hole lid and clamping ring closure.

All known plastics barrels having an upper carrying and transporting ring have however the common disadvantage that because of the bung hole socket and/or the bung hole housing being sunk into the upper end of the drum, problems arise when emptying a residue from drums of this kind. The residue emptying achievable by manually rocking the barrel to and fro in a slopingly tilted inverted position is also unsatisfactory, even when the drum is held in such a manner that the bung hole occupies the lowest possible position.

It is an object of the present invention to provide a constructional embodiment of a plastics bung barrel and/or of its upper end (lid), which facilitates the most complete emptying of residue possible, in a stationary sloping position (without rocking to and fro).

This object is achieved according to the invention for a plastics drum of the type initially described in that the upper end has a substantially segmentally-shaped surface portion or a flat slope, which is formed symmetrically with respect to the bung hole socket on both sides and, when seen in the normal position of the barrel, is set back in a flat sloping manner extending in the direction of the edge of the barrel and sloping inwardly into the body of the barrel, the slope having its lowest point at the side of the shell of the barrel in the vicinity of the bung hole socket and there running into the lower-lying plane of the bung hole housing base or into the bung hole socket. As the upper end is not formed to be uniformly flat, but rather has the slope which is fundamental to the invention in the region of the bung hole, when emptying a residue and the barrel is in an inverted disposition at a slightly tilted but stationary inclined disposition of the barrel of, for example, 10° to 12°, the residual liquid flows on the inside of the flattened portion towards the barrel wall to the bung hole housing and out of the barrel through the bung hole socket.

In a preferred embodiment of the invention, it is provided that the slope defines a flat bent edge with the remainder of the upper end of the barrel, the average distance of which from the centre of the barrel is approximately equal to or less than one-quarter of the diameter of the barrel, the sinking-in of the bung hole housing on the side facing towards the centre of the barrel beginning at the bent edge or close to it, but having however a greater bend angle relative to the upper end than the slope of the upper end segmental portion in the region of the bung hole socket. What is essential in this is that the greatest possible area of the original planar upper end region remains, since an overly extensive sloping of the upper end would reduce the bearing area when stacking the barrel and would therefore worsen the stacking capability of the barrel.

In an embodiment of the invention for a bung barrel with a bung hole lid which seals at the bottom in the bung hole socket, it is provided that the sinking-in/bend of the bung hole housing on the side facing the centre of the barrel is between 30° and 45°, preferably approximately 40°, and the slope of the upper end segmental portion has a bend angle between 10° and 17°, preferably about 13°. Emptying a residue from this bung barrel, which has an extended bung basin, is thus effected by simple tilting of the barrel in an inverted disposition and holding it in an inclined orientation at a tilt angle of 18° to about 20°. In another embodiment of the invention for a bung barrel with a bung lid which seals at the top on the edge of the bung hole socket, it is provided that the slope of the upper end segmental portion extends more flatly or has a flat bend angle of between 4° and 10°, preferably about 6°, and that a gap or a through opening is formed in the bung hole socket which seals at the top on the side facing towards the wall of the barrel, for the residual liquid to drain out. The emptying of residue takes place for this barrel therefore by tilting the barrel in an inverted disposition and holding it in a slightly inclined orientation at a small angle of tilt of approximately 10° to 12°.

The drum according to the invention is, because of the constructional embodiment of its upper end or of a corresponding barrel lid, suited to automatically emptying itself without leaving a residue and without manually tilting to and fro, once it is ensured that, for example by means of a simple suitable holding device, the barrel remains in a predetermined tilted position in which the bung hole is located at its lowest point.

The invention will now be explained and described in more detail having regard to the embodiments illustrated in the drawings.

Figure 5:
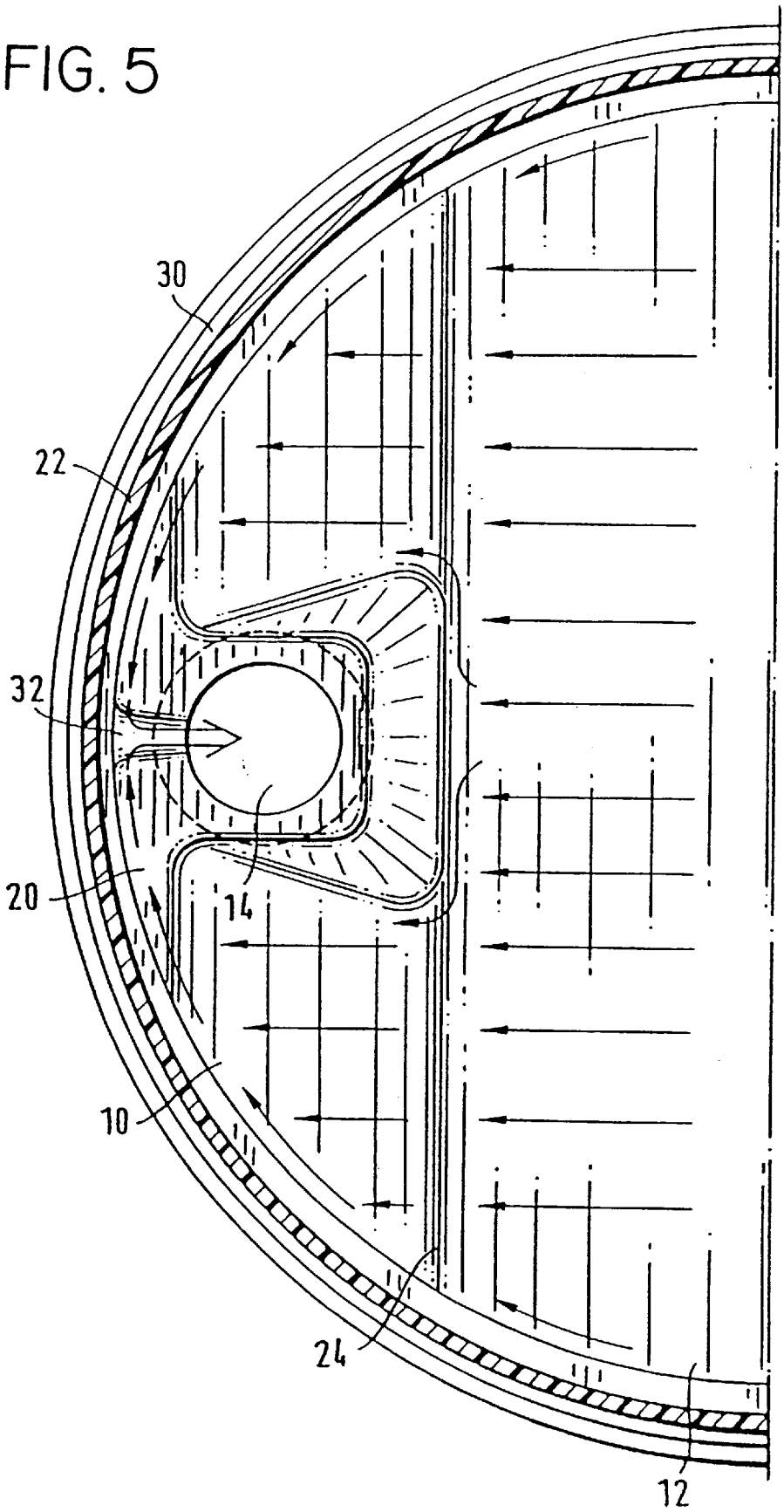

FIG. 1 shows a portion of a barrel according to the invention in the region of the bung hole, FIG. 2 shows the barrel depicted in FIG. 1 in a tilted position for emptying residue, FIG. 3 shows a second modified embodiment of a plastics drum according to the invention, FIG. 4 shows a top view of the drum according to another embodiment of the invention, FIG. 5 shows a view of FIG. 4 from inside onto the upper end of the drum in the residue-emptying disposition, FIG. 6 shows a further embodiment of a plastics barrel with a bung hole socket sealing at the top, FIG. 6*a* shows a partial view of the lower part of the bung hole socket of FIG. 6, FIG. 7 shows another embodiment of a plastics barrel with a bung hole socket sealing at the top, FIGS. 7*a* and 7*b* show a partial view and sectional illustration respectively of the lower part of the bung hole socket of FIG. 7 and FIG. 8 shows a further embodiment of a drum (lid) upper end according to the invention, FIG. 9 shows another embodiment according to the invention in a perspective partial view, and FIG. 10 shows a final embodiment according to the invention in a perspective overall view.

FIG. 1 shows a stackable bung barrel made of thermoplastic synthetic material for essential complete residue emptying, which was produced with an integral upset gripping ring using the blow-moulding process. The barrel has a cylindrical barrel shell 22 with a barrel gripping ring 30 located in the upper peripheral region for use with a barrel gripper and a flat barrel upper end 12. In this connection, the upper surface of the barrel upper end projects beyond the upper edge of the barrel gripping ring 30 by about three times the wall thickness of the barrel. A bung hole 14 is provided in the barrel upper end 12 in the vicinity of the barrel shell 22. The bung hole 14 is surrounded by a bung hole socket 16, which is sunk into a bung hole housing 18 in such a manner that the end face of the bung hole socket 16 terminates flush with the external surface of the barrel upper end 12 or is sunk in marginally deeper. The bung hole socket is sealed below the thread on the sloping taper of the diameter.

A segmentally-shaped surface portion or a substantially planar or flat slope 10 of the upper end 12 is indented symmetrically with respect to the bung hole socket 16 and with respect to the outer edge of the barrel to extend in a flat sloping manner sloping inwardly into the body of the barrel, the slope 10 having its lowest point at the side of the barrel shell 22 and there merging flush into the lower lying plane of the bung hole socket base 20.

Reference numeral 24 denotes a bend edge extending (in this instance) in a straight line, between the barrel upper end 12 and the slope 10. The sinking-in of the bung socket housing 18 extends in this case a little beyond the bend edge 24 in the direction of the centre of the barrel. This bung socket housing wall is sunk in at an angle 38 of between 30° and 45° preferably approximately 40°, with respect to the barrel upper end 12, while the slope 10 starting at the bend edge 24 is bent relative to the barrel upper end 12 at an angle 36 of between 10° and 17°, preferably approximately 13°. At its lowest point, the slope 10 abuts the root region of the carrying and transporting ring 30 or its point of connection to the barrel shell 22 on the interior of the barrel shell.

The residue-emptying position of the bung barrel can be seen from FIG. 2. The barrel is tilted in an inverted disposition to an angle of approximately 18° to 20° for this and is maintained stationary in this tilted position preferably by means of a suitable tilting device. Because of the difference in angle between the flattened portion and the tilting angle, the fluid content can flow completely of its own volition, and without leaving any residue, over the flattened portion 10 to the wall 22 of the barrel and from there through the bung housing or the bung hole socket 16.

A somewhat modified embodiment is shown in FIG. 3. The sinking-in of the bung hole housing 18 begins in this case on the side facing towards the centre of the barrel exactly at the bend edge 24. However, the sunk-in portion has a steeper bend angle relative to the upper end 12 of the barrel than the slope 10 of the segmental portion of the upper end of the barrel in the region of the bung hole socket 16. A rib-like raised portion 34 is further provided in the slope 10 between barrel wall 22 and bung hole socket 16, with a corresponding groove-form depression 32 on the inside. Thus it is ensured that the very last of the contents can flow out of the sunken portion between slope 10 and internal wall 22 of the barrel, without leaving any residue behind, when the barrel is in a tilted disposition. A further difference lies in the upper edge of the gripping ring 30 being formed flush with or to be the same height as the upper surface of the upper end of the barrel.

In FIG. 4, the relevant part of the barrel upper end 12 of another modified embodiment is shown in top view. This shows that the slope 10 with the remainder of the barrel upper end 12 defines the flat bent edge 24, the spacing 26 of which from the central point 28 of the barrel (which is also the center of the upper end of the barrel) is roughly equal to or less than a quarter of the diameter of the barrel. The sinking-in of the bung hole housing 18 starts at the bent edge 24. The slope 10 runs into the flat floor 20 of the bung hole housing 18 on the bung hole side. The relatively small rib-like elevation 34 extends between internal barrel wall 22 and the bung hole socket 16.

The flow-chart for the remaining drops of liquid of the fluid content is shown in FIG. 5. According to this, fluid residue flows from the internal surface of the upper end 12 substantially at right angles over the bend edge 24 to the Internal curved wall 22 of the barrel and along this into the valley in the region of the bung hole housing floor 20. From this collection point, the last of the fluid residue flows through the short, relatively shallow, radially extending groove 32 into the bung hole socket 16 and out of the barrel.

A further modification for promoting the speed of flow of the last of the fluid residue consists of—as indicated in FIG. 3 by the lowermost sloping line of the slope 10—both halves of the slope 10 (considered in the inverted disposition) being slightly inclined towards one another to fall away in the direction of the bung hole, i.e. that they enclose an internal total angle of approximately 175° at the bung hole socket (centre line running through the bung hole 14 and the centre 28 of the barrel).

A further blow-moulded plastics barrel having an alternative bung hole socket 44 is illustrated in FIG. 6. In this bung hole socket 44, the screwed-on lid of the bung hole (not illustrated) seals the barrel by means of a suitable seal against the upper edge or flanged edge of the bung hole socket—by contrast with the barrel illustrated in FIG. 1, in which the bung hole lid seals by means of a seal in the lower part of the somewhat set back bung hole socket 16. Thus, in this embodiment, a gap 46 may be formed on the side of the internal or lower part of the bung hole socket 44 facing the wall 22 of the barrel, through which gap 46 the converging residual fluid can flow out of the barrel when the barrel is in a residue-emptying or tilted inverted disposition. By means of this additional feature, namely the gap 46 in the lower edge of the bung hole socket—as can be seen also from the partial illustration in FIG. 6*a*—it is sufficient for the slope 40 of the barrel upper end segmental portion to have a flat bend angle 42 or a relatively flat inclination of between 4° and 10°, preferably approximately 6°, and to run into the sloping, conically indented edge region of the barrel upper end 12 at its lowest point, approximately at one-half the height of the long vertical leg of the carrying and transporting ring 30, a gap 46 or a through opening 50 being provided in the bung hole socket 44 (48) on the side facing the shell 22 of the barrel, for the residual fluid to flow out.

A barrel lid embodiment produced by means of the injection molding process, having a cylindrical bung hole socket 48, is illustrated in FIG. 7. The barrel upper end is here formed in the same manner as for the barrel illustrated in FIG. 6, only the bung hole socket 48 is set lower into the bung hole housing 18 and a part of it juts into the interior of the barrel, as this bung hole socket is also sealed on the upper edge by the screwed-on bung hole lid (not illustrated). For the last of the converging residual fluid to be able to flow out unhindered in this case also, this bung hole socket 48 has a suitable through opening 50 on its side facing the wall 22 of the barrel. The through opening 50 in the bung hole socket is illustrated in FIG. 7*a* in sectional view and in FIG. 7*b* in side view, once again for the purpose of clarification.

This embodiment of the barrel upper end, which is produced by means of the injection molding technique and which is welded to a, for example, blow-moulded barrel shell having a barrel base, can however also be produced as a completely one-piece plastics barrel by means of the blow-moulding process, so that only the bung hole socket is preproduced as a separate injection molded component and is welded into the bung hole housing base at a suitable point.

In the embodiments according to FIGS. 6 and 7, in which the bung stopper has a seal located at the top, the short draining groove 32 (see FIG. 5) may run from the barrel edge into the bung hole at a higher level in the bung housing, automatic complete residue-emptying being nonetheless achievable.

In the top view of the bung barrel upper end according to FIG. 8, the bend edge between barrel upper end and slope does not run entirely straight. Rather, the two halves of the slope run somewhat inclined towards each other on the bend edge. At the same time, both half surfaces of the slope can then be somewhat inclined towards each other with a fall to the bung hole when in the inverted position, in order to promote the draining of residual fluid.

It is notable here that the smaller of the two bungs serves as a draining bung and is positioned within the slope.

In this and in another embodiment, i.e. with a combination of several features according to the invention, a conventional standard lid can however also be similarly formed, which is mounted on the upper opening of an wide-necked container (open top drum) by means of a locking ring closure.

In the perspective partial view according to FIG. 9, the bend edge of the slope is formed in the shape of a crescent or an arc, the two half surfaces of the slope not necessarily being flat, but being also capable of being formed to be curved slightly outwards.

Finally, a perspective overall view of a version of barrel according to the invention is illustrated in FIG. 10, this version being particularly suited to being produced by means of the tandem blow-moulding technique.

Here two barrel bodies having lower ends are blown simultaneously in one blow-mould, are cut apart in the centre, and an upper end preproduced by the injection molding process and having an external handling ring, is welded onto the barrel body of each preproduced product.

Any desired combinations of the features shown lie within the ambit of the invention. Thus the bend edge 24 between slope 10 and the remainder of the barrel upper end 12 may also be formed in the shape of an arc of large radius or curved in the shape of a crescent, with increase in or reduction of the slope 10 in the outer edge regions. These measures according to the invention are equally suited either to a one-piece blow-moulded bung barrel with an upset gripping ring or to a barrel welded or glued together from preproduced individual components (barrel upper end with gripping ring, barrel base and cylindrical wall). The barrel can also be formed as a lid barrel (wide neck container) with a clampable lid of plastics or steel sheet, the lid here having the features according to the invention.

When stacking plastics barrels over a long period of time, it can arise that the upper ends of the barrels stacked underneath can sink slightly downwards, towards the interiors of the barrels, as a consequence of the weight of stacking. In conventional plastics barrels with an externally embossed upper end, the possibility of emptying the residue is hindered by this, whereas in plastics barrels according to the invention, this phenomenon promotes residue emptying rather than hindering it.

We claim:

1. A bung drum made of thermoplastic and having a drum wall and upper end, comprising: a surrounding carrying and transport ring (30) disposed at the drum wall (22) in the vicinity of said upper end (12); and at least one bung hole connection piece (16) having a top terminal end and disposed in the upper end (12) adjacent said drum wall, said bung hole connection piece being recessed in a bung hole housing (18) having a bung hole housing base (20) disposed below said upper end (12) when the drum is in its normal upright position, with said terminal end of the bung hole connection piece (16) terminating adjacent said upper end (12), wherein the upper end (12), next to the bung hole housing (18), has a part that is in the shape of a circular segment defining a bevel (10), which is formed of two halves symmetrically on both sides of the bung hole connection piece (16) and, when viewed in the normal upright position of the drum, extends downwardly at a slant into the interior of the drum in a manner that is beveled, such that the bevel (10) has its lowest point adjacent the drum wall (22) in the vicinity of the bung hole connection piece (16) and said lowest point of said bevel merges into the lower lying plane of the bung hole housing base (20).

2. The drum according to claim 1, wherein the bevel (10) together with the remaining upper end (12) of the drum forms a bend edge (24), whose average distance (26) from the center (28) of the drum is no treater than one-quarter of the drum diameter.

3. The drum according to claim 1, wherein the bung hole connection piece housing (18) begins at a bend edge (24) on that side which faces toward the center of the drum, and has an angle of slope (38) with respect to the upper end (12) which is greater than the slant of the bevel (10) of the circular segment of the upper end in the area of the bung hole connection piece (16).

4. The drum according to claim 3, wherein the angle of slope of the bung hole connection-piece housing (18) amounts to between 30° and 45°and the slant of the bevel (10) of the circular segment of the upper end has an angle of slope (36) between 10° and 17°.

5. The drum according to claim 2 or 3 wherein the bend edge (24) between the flat upper end (12) of the drum and the bevel (10) is sickle-shape, with a curvature running out toward the bung hole connection piece (16).

6. The drum according to claim 1 wherein said upper end (12) of said drum has a center; and said bevel, with reference to a radius passing through said center and said bung hole connection piece (16) extends downwardly from a first location radially inwardly of said bung hole connection piece to a second location defined by said lowest point.

7. The drum according to claim 1, wherein said upper end (12) of said drum has a center; said bung hole is located on a radius extending from said center to said carrying and transport ring (30); the bung hole housing base (20) extends into a first area disposed between said bung hole connection piece and said carrying and transport ring and further extends from said first area into second areas disposed laterally to either side of said radius and said bung hole connection piece, said second areas extending to said carrying and transport ring; and said bevel at said lowest point on each side of said bung hole connection piece merges into said second areas of said bung hole housing base.

8. The drum according to claim 7, wherein the first area, as viewed from the interior of the drum includes a trough-like depression (32) extending from said carrying and transport ring (30) to said bung hole connection piece.

9. The drum according to claim 7, wherein the bevel (10) together with the remaining upper end (12) of the drum forms a bend edge (24), whose average distance (26) from the center (28) of the drum is no greater than one-quarter of the drum diameter.

10. The drum according to claim 7, wherein the bung hole connection piece housing (18) begins at a bend edge (24) on that side which faces toward the center of the drum, and has an angle of slope (38) with respect to the upper end (12) which is greater than the slant of the bevel (10) of the circular segment of the upper end in the area of the bung hole connection piece (16).

11. The drum according to claim 7, wherein the angle of slope of the bung hole connection-piece housing (18) amounts to between 30° and 45° and the slant of the bevel (10) of the circular segment of the upper end has an angle of slope (36) between 10° and 17°.

12. In a bung drum made of thermoplastic synthetic material and having a drum wall, an upper end and a circumferential carrying and transport ring disposed on the drum wall in the region of the upper end and further having at least one bung hole connection piece disposed in the upper end adjacent said drum wall, which bung hole connection piece is depressed into a bung hole housing having a bung hole housing base located along a plane disposed below the upper end of the drum when the drum is in its normal upright position; the improvement wherein the upper end includes a slope surface which, with reference to a radius passing through the center of the upper end and the bung hole connection piece, extends on diametrically opposite sides of the bung hole connection piece and which with reference to the normal upright position of the drum, extends at an angle of slope downwardly away from the center of the upper end from a first location radially inwardly of said bung hole connection piece to a second location adjacent the drum wall in the vicinity of the bung hole connection piece where the slope surface merges into the lower lying plane of the bung hole housing base.

13. In a bung drum made of thermoplastic synthetic material and having a drum wall, an upper end and a circumferential carrying and transport ring disposed on the drum wall in the region of the upper end and further having at least one bung hole housing having a bung hole housing base located along a plane disposed below the upper end of the drum when the drum is in its normal upright position, and a bung hole connection piece disposed in the upper end adjacent said drum wall and depressed into said bung hole housing, said bung hole connection piece having a top terminal end and a lower end connected to said bung hole housing base to provide an opening into said drum; the improvement wherein the upper end includes a slope surface which, with reference to a radius passing through the center of the upper end and the bung hole connection piece, extends on diametrically opposite sides of the bung hole connection piece and which with reference to the normal upright position of the drum, extends at an angle of slope downwardly away from the center of the upper end and to a location adjacent the drum wall in the vicinity of the bung hole connection piece and there merges into the lower lying plane of the bung hole housing base so that in an emptying position of the drum in which it is inclined through more than 90° relative to its upright position, about an axis extending perpendicular to said radius, at least a part of said bung hole connection piece along said radius, where it connects with said bung hole housing base, is, when measured in a direction perpendicular to said slope surface, no higher than said slope surface.

14. In a bung drum made of thermoplastic synthetic material and having a drum wall, an upper end and a circumferential carrying and transport ring disposed on the drum wall in the region of the upper end and further having at least one bung hole connection piece disposed in the upper end adjacent said drum wall, which bung hole connection piece is depressed into a bung hole housing having a bung hole housing base located along a plane disposed below the upper end of the drum when the drum is in its normal upright position, said bung hole connection piece having a top terminal end terminating at a location no higher than the location of said upper end; the improvement wherein the upper end includes a slope surface which, with reference to a radius passing through the center of the upper end and the bung hole connection piece, extends on diametrically opposite sides of the bung hole connection piece and which with reference to the normal upright position of the drum, extends at an angle of slope downwardly away from the center of the upper end from a first location radially inwardly of said bung hole connection piece to a second location adjacent the drum wall in the vicinity of the bung hole connection piece where the slope surface merges into the lower lying plane of the bung hole housing base.

15. In a bung drum made of thermoplastic synthetic material and having a drum wall, an upper end and a circumferential carrying and transport ring disposed on the drum wall in the region of the upper end and further having at least one bung hole connection piece disposed in the upper end adjacent said drum wall, which bung hole connection piece is depressed into a bung hole housing having a bung hole housing base located along a plane disposed below the upper end of the drum when the drum is in its normal upright position; the improvement wherein the upper end includes a slope surface which, with reference to a radius passing through the center of the upper end and the bung hole connection piece, extends on diametrically opposite sides of the bung hole connection piece and which with reference to the normal upright position of the drum, extends at an angle of slope downwardly away from the center of the upper end from a first location radially inwardly of said bung hole connection piece to a second location adjacent the drum wall in the vicinity of the bung hole connection piece where the slope surface merges into the bung hole connection piece.

16. A drum according to either one of claims 14 and 15, wherein the slope surface defines a bend edge with the remainder of the upper end of the drum which is spaced by a distance from the center of the upper end, as measured along said radius, no greater than about a quarter of the diameter of the upper end of the drum.

17. A drum according to either one of claims 14 and 15, wherein the bung hole housing slopes in the same direction as said slope surface and at an angle of slope which is a larger angle than the angle of slope of the slope surface.

18. A drum according to claim 17, wherein the angle of the slope of the bung hole housing is between about 30° and 45° and the angle of slope of the slope surface is between about 4° and 17°.

19. A drum according to claim 18, wherein the angle of slope of the bung hole housing is about 40° and the angle of the slope of the slope surface is about 13°.

20. A drum according to either one of claims 14 and 15, wherein the bung hole housing begins sloping at the bend edge.

21. A drum according to claim 14, wherein the carrying and transport ring connects with the drum wall by a leg having a lower end connected to the drum wall and extending generally axially upwardly from the drum walls and the slope surface, on either side of the bung hole housing, slopes downwardly to the lower end of said leg.

22. A drum according to claim 15, wherein the drum wall is connected to the upper end of the drum by a conical wall; the carrying and transport ring connects with the drum wall by a leg having a lower end connected to the drum wall at the area of connection of the conical wall to the drum wall; the bung hole connection piece includes a seal area located in an upper region of the bung hole connection piece; the slope surface slopes downwardly at an angle of slope between about 4° and 10° and merges with the conical wall about centrally of said leg; the bung hole connection piece includes an internal portion extending downwardly below said slope surface into the interior of the drums and said internal portion includes an opening immediately below said slope surface, said opening facing toward said drum wall.

23. A drum according to either one of claims 14 and 15, wherein the slope surface defines a bend edge with the remainder of the upper end of the drum which extends from either side of bung hole housing at a slight inclination toward diametrically opposite sides of the upper end, as measured laterally of said radius.

* * * * *

UNITED STATES PATENT AND TRADEMARK OFFICE

CERTIFICATE OF CORRECTION

PATENT NO. : 5,975,338
DATED : November 2, 1999
INVENTOR(S) : Dietmar Przytulla et al.

It is certified that error appears in the above-identified patent and that said Letters Patent is hereby corrected as shown below:

Column 6,
Line 36, change “treater” to -- greater --.
Line 47, change “45ºand” to -- 45º and -- (add a space).

Column 9,
Line 7, change “walls” to -- wall; --.

Column 10,
Line 5, change “drums” to -- drum; --.

Signed and Sealed this

Twenty-fourth Day of August, 2004

JON W. DUDAS
*Director of the United States Patent and Trademark Office*